United States Patent [19]

Harris

[11] Patent Number: 5,059,096

[45] Date of Patent: Oct. 22, 1991

[54] FUEL PUMPING APPARATUS

[75] Inventor: Kenneth M. Harris, Kent, England

[73] Assignee: Lucas Industries Public Limited Company, West Midlands, United Kingdom

[21] Appl. No.: 638,724

[22] Filed: Dec. 26, 1990

[51] Int. Cl.[5] ..... F04B 1/06

[52] U.S. Cl. ..... 417/221; 417/462

[58] Field of Search ..... 417/462, 221; 91/482, 91/491; 92/72

[56] References Cited

U.S. PATENT DOCUMENTS

| | | | |
|---|---|---|---|
| 4,195,553 | 4/1980 | Klie | 417/221 |
| 4,376,432 | 3/1983 | Davis | 417/462 |
| 4,453,522 | 6/1984 | Salzgeber | 417/462 |
| 4,526,154 | 7/1985 | Didomenico | 417/462 |
| 4,531,491 | 7/1985 | Iiyama | 417/462 |

*Primary Examiner*—Richard A. Bertsch
*Assistant Examiner*—Peter Korytnyk
*Attorney, Agent, or Firm*—Trexler, Bushnell, Giangiorgi & Blackstone, Ltd.

[57] ABSTRACT

A rotary distributor type fuel pumping apparatus has an annular cam ring having internal cam lobes which impart inward movement to a pumping plunger as the distributor member is rotated. A piston is movable in a cylinder to vary the angular setting of the cam ring and the piston is coupled to the cam ring by means of a member having a gear tooth profile which is located in a recess in the piston. The member is integrally formed with a mounting having a pair of oppositely extending arms which are individually secured against mutually inclined flats on the periphery of the cam ring.

5 Claims, 1 Drawing Sheet

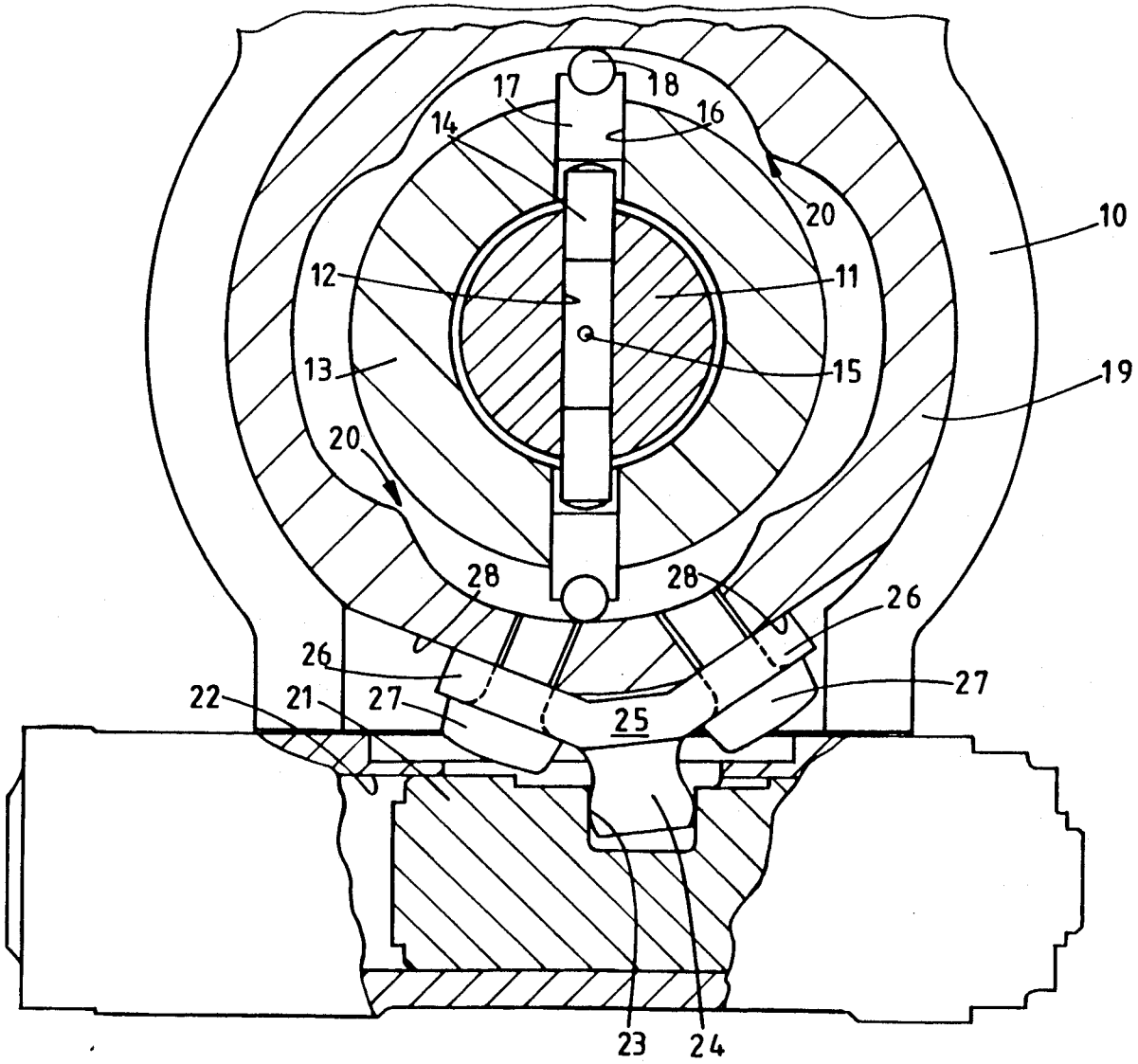
10
19
20
11
15
16
18
17
14
12
13
20
28
28
26
27
25
26
27
21
22
24
23

FUEL PUMPING APPARATUS

BACKGROUND OF THE INVENTION

This invention relates to a liquid fuel pumping apparatus of the kind comprising a rotary distributor member mounted in a pump body and arranged in use to be driven in timed relationship with an associated engine to which it is intended to supply fuel, an annular cam ring surrounding the distributor member, the cam ring having cam lobes formed on its internal peripheral surface, for imparting inward movement to a pumping plunger mounted in a transverse bore in the distributor member in turn as the distributor member rotates, fuel being displaced from the bore during the inward movement of the pumping plunger and being supplied to the injection nozzles in turn of the associated engine, a fluid pressure operable piston for moving the cam ring angularly about the axis of rotation of the distributor member to adjust the timing of fuel delivery and coupling means connecting the piston with the cam ring.

The usual form of coupling means comprises a peg which is secured to the cam ring, the peg having a spherical end which locates in a circular recess in the side wall of the piston. The conventional practice is to secure the peg with a screw thread and to provide a complementarily threaded aperture in the cam ring into which the peg is screwed. The peg has to absorb the reaction force which is imparted to the cam ring as a cam follower associated with the plunger engages the cam lobes. As the pressure at which fuel is delivered to the associated engine is increased the reaction force is increased. The construction as described cannot be strengthened to any significant extent without substantial re-design of the apparatus and the object of the present invention is to provide a coupling means in a simple and convenient form.

SUMMARY OF THE INVENTION

According to the invention in an apparatus of the kind specified the coupling means comprises a tooth like member for engagement within a recess formed in the side wall of the piston and an integral mounting for the member, said mounting comprising a pair of arms extending in opposite directions relative to the tooth like member, the arms being shaped for engagement with the outer peripheral surface of the cam ring and being individually secured to the cam ring.

BRIEF DESCRIPTION OF THE DRAWING

An apparatus in accordance with the invention will now be described with reference to the accompanying drawing which is a sectional side elevation through part of the apparatus.

DETAILED DESCRIPTION OF THE PREFERRED EMBODIMENT

Referring to the drawing the apparatus comprises a body part 10 in which is journaled a rotary cylindrical distributor member 11 in which is formed a transversely extending bore 12. Surrounding the distributor member is the enlarged portion 13 of a drive shaft which is journaled within the pump body and which in use is driven in timed relationship with the associated engine. The distributor member is coupled to the drive shaft so as to be driven thereby.

Mounted within the bore 12 is a pair of pumping plungers 14 and intermediate the pumping plungers the bore is connected to a passage 15 which extends in known manner, axially within the distributor member. The passage 15 communicates with a delivery passage extending to the periphery of the distributor member and which can register in turn with outlet ports formed in the pump body and connected in use, to the injection nozzles of the associated engine. The passage 15 also communicates with a plurality of inlet passages which also extend to the periphery of the distributor member and which can register in turn with an inlet port connected to a source of fuel under pressure. In use, during inward movement of the plungers 14 the delivery passage will be in register with an outlet so that the fuel displaced during the inward movement of the plungers will be supplied to an injection nozzle of the associated engine. As the distributor member further rotates the delivery passage will move out of register with the outlet and an inlet passage will move into register with the inlet port and fuel will be supplied to the bore 12 to effect outward movement of the plungers. The quantity of fuel supplied to the bore may be controlled in order to vary the amount of fuel supplied to the associated engine alternatively some fuel may be spilled from the bore during the inward movement of the plungers for the same purpose.

The enlarged portion 13 of the drive shaft is provided with a pair of slots 16 which accommodate cam followers each cam follower comprising a shoe 17 and a roller 18. The rollers engage with the internal peripheral surface of an annular cam ring 19 mounted in the pump body and on the internal peripheral surface of which is formed a plurality of cam lobes 20. In order to vary the timing of fuel delivery to the associated engine the cam ring 19 is angularly adjustable and for this purpose a fluid pressure operable piston 21 is provided, the piston being mounted within a cylinder 22 to which fuel under pressure can be admitted to determine the position of the piston.

The cylinder 22 is tangentially disposed relative to the cam ring 19 and formed in the wall of the piston is a slot 23 into which projects a gear tooth shaped member 24 which is integrally formed with a mounting 25. The mounting 25 has a pair of arms 26 extending in opposite directions relative to the member 24, the arms being shaped to engage the peripheral surface of the cam ring and the arms are individually secured to the cam ring by means of set screws 27 respectively.

Conveniently and as illustrated, the peripheral surface of the cam ring is provided with a pair of mutually inclined flats 28 and the arms of the mounting are shaped in a complementary manner. The mounting and the arms may extend the full width of the cam ring and the provision of the flats and the complementary surfaces on the arms 26 firstly provides for self location of the mounting relative to the cam ring and it also enables a proportion of the torque which is developed when the rollers engage the leading flanks of the cam lobes, to be transmitted to the member 24 by means of friction. It will be noted that the screw threaded apertures which are formed in the cam ring to receive the set screws, are formed in a portion of the cam ring between adjacent cam lobes. In order to enhance the transmission of torque the surfaces of the flats and/or the arms can be roughened or serrated.

The root portion of the gear tooth member 24 is machined to provide clearance with the side walls of the recess 23 when the piston is at its extreme positions but the tooth member as compared with the prior art peg, offers a substantially larger cross sectional area of material to resist the load which is applied during the operation of the apparatus. Furthermore, in order to minimise any problems which may arise due to misalignment of the piston, the tooth member 24 is barrelled.

I claim:

1. A liquid fuel pumping apparatus comprising a rotary distributor member mounted in a pump body and arranged in use to be driven in timed relationship with an engine with which the apparatus is associated an annular cam ring surrounding the distributor member, the cam ring defining cam lobes on its internal surface for imparting inward movement to a plunger slidable in a transverse bore in the distributor member, the fuel being displaced from the bore during successive inward movements of the plunger, a fluid pressure operable piston for moving the cam ring angularly about the axis of rotation of the distributor member to adjust the timing of fuel delivery and coupling means connecting the piston with the cam ring characterised in that said coupling means comprises a tooth like member for engagement within a recess in the side wall of the piston, an integral mounting for the tooth like member, said mounting comprising a pair of arms extending in opposite directions relative to the tooth like member, the arms being shaped for engagement with the outer peripheral surface of the cam ring and being individually secured to the cam ring.

2. An apparatus according to claim 1, characterised in that said cam ring defines a pair of mutually inclined flats against which the arms are secured respectively.

3. An apparatus according to claim 2, in which said arms are secured by set screws against said flats respectively.

4. An apparatus according to claim 2 or claim 3, characterised in that the surfaces of the flats and the surfaces of the arms are roughened.

5. An apparatus according to claim 2 or claim 3, characterised in that the surfaces of the flats or the surfaces of the arms are roughened.

* * * * *